US005612504A

United States Patent [19]

Stitt et al.

[11] Patent Number: 5,612,504

[45] Date of Patent: Mar. 18, 1997

[54] MUZZLE BRAKE FOR RIFLE OR SIMILAR FIREARMS

[76] Inventors: Michael R. Stitt, 9191 Pine Knob Dr., Clarkston, Mich. 48348; Joseph C. Kapelczak, 3656 Lorena, Waterford, Mich. 48329; Lauchlan C. McInnes, 8897 Eaton Rd., Davisburg, Mich. 48350

[21] Appl. No.: 147,114

[22] Filed: Nov. 3, 1993

[51] Int. Cl.[6] ..... F41A 21/36

[52] U.S. Cl. ..... 89/14.3

[58] Field of Search ..... 42/79; 89/14.2, 89/14.3

[56] References Cited

U.S. PATENT DOCUMENTS

| | | | |
|---|---|---|---|
| D. 158,792 | 5/1950 | Powell et al. | 89/14.3 |
| 785,973 | 3/1905 | McClean | 89/14.3 |
| 1,342,978 | 6/1920 | Young | 89/14.3 |
| 1,363,058 | 12/1920 | Schneider | 89/14.3 |
| 2,662,326 | 12/1953 | Powell | 89/14.3 |
| 2,963,943 | 12/1960 | Cutts | 89/14.3 |
| 3,114,289 | 12/1963 | Aulabaugh | 89/14.3 |
| 3,710,683 | 1/1973 | Kaltmann | 89/14.2 |
| 5,092,223 | 3/1992 | Hudson | 89/14.2 |
| 5,305,677 | 4/1994 | Kleinguether et al. | 89/14.2 |

*Primary Examiner*—Michael J. Carone
*Attorney, Agent, or Firm*—Weintraub, DuRoss & Brady

[57] ABSTRACT

A muzzle brake for a rifle or firearm serves to dissipate the forces generated by the weapon during firing which, if not dissipated, could affect the intended trajectory of the projectile. The present muzzle brake is a cylindrical member having a plurality of slots formed therein. The slots permit the egress of the gases formed during firing. The slots are formed in an arrangement such that the gases are equally dispelled in all directions. The cylindrical member may be formed such that the diameter thereof lessens.

3 Claims, 1 Drawing Sheet

MUZZLE BRAKE FOR RIFLE OR SIMILAR FIREARMS

BACKGROUND OF THE INVENTION

1. Field of the Invention

The present apparatus concerns an attachment to a rifle. More particularly, the present invention concerns a muzzle-brake attachment to the forward end of a rifle to negate the forces associated with the firing of a rifle.

2. Prior Art

One example of prior attempts to address this problem is found in U.S. Pat. No. 3,114,289 issued Jul. 12, 1962 to Aulabaugh and is entitled, "MUZZLE BRAKE". Aulabaugh teaches an elongated tubular assembly which threadingly attached at the rearward end thereof to the forward end of a rifle barrel. The forward end of the muzzle brake has a plurality of loose radial slots formed therein. The muzzle brake further has protrusions formed in the tubular assembly to direct the expulsion of the gases formed therein during firing. This then attempts to effect an even expulsion of the gases by the radial slots thereof. Yet imbalances still occur, not compensated for by this design.

Another example of a muzzle brake is found in U.S. Pat. No. 3,710,683 issued Jan. 16, 1973 to Kaltmann and is entitled, "MUZZLE-BRAKE WITH A FLASH HIDER FOR AUTOMATIC WEAPONS AND GUNS". Kaltmann teaches an integral member having at its rearward end a threaded extension for attachment to the rifle barrel. The medial portion of the integral member, which forms the muzzle brake, comprises a cylindrical shell with a central bore formed therein. A matrix of bores is distributed evenly around the member, the matrix having five rows of twelve bores each. However, the regular matrix does not achieve the force alleviation desired.

Still another example of an attempt to address the problem of alleviating the force associated with discharging a weapon is found in U.S. Pat. No. 2,662,326 issued May 30, 1950 to Powell et alia and is entitled, "SHOT PATTERN CONTROL MUZZLE ATTACHMENT FOR FIREARMS". Powell teaches a cylindrical member having two rows of V-shaped slots formed therein to allow the gases to dispel therethrough. This design also does not achieve the balanced dispersion of the discharge forces sought for by firearm shooters.

It is to this end of balanced dispersion of the discharge forces of a rifle or similar firearm that the present invention is directed.

SUMMARY OF THE INVENTION

The present invention is a muzzle brake attachment for a rifle or similar firearm, comprising:

(a) a cylindrical member having:

(1) a forward end, (2) a medial portion and (3) a rearward end, the medial portion having a plurality of slots formed therein, the slots being formed in a plurality of rings, each ring comprising three slots, the slots of each rings being deployed such that no slot in any one ring aligns with any slot from another ring. By this arrangement of the slots, the forces generated during firing are equally dissipated around the gun.

The number of rings may vary, with the preferred number of rings being four. An alternate embodiment of three rings is also envisioned. Further, means for attaching the muzzle brake to the rifle is provided.

The present invention will be more clearly understood with reference to the accompanying drawings, in which like reference numerals refer to like parts, in which:

DETAILED DESCRIPTION OF THE PREFERRED EMBODIMENTS

Figure 1:
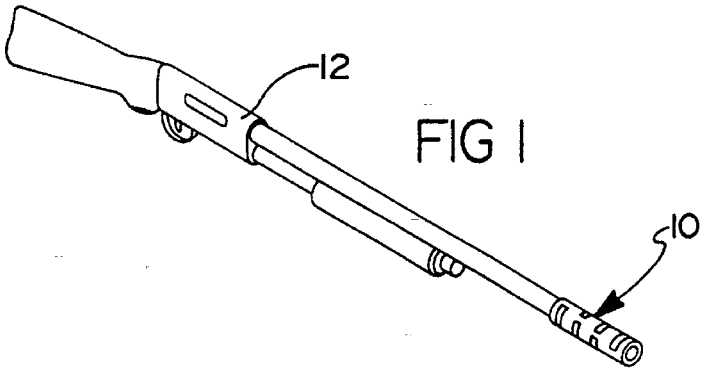
FIG. 1 is an environmental view of the muzzle brake of the present invention, the muzzle brake being attached to a rifle.

Referring now to FIG. 1, we see therein the present invention, to wit, a muzzle brake 10 attached to a rifle 12. It is noted that, while most commonly used in connection with firearms such as the rifle 12, the muzzle brake 10 of the present invention may be adapted to work with other firearms, such as pistols, revolvers and machine guns.

Figure 3:
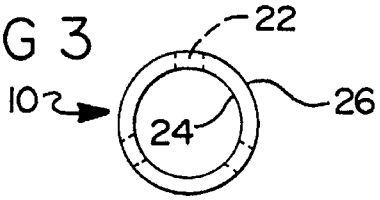
FIG. 3 is a forward end view of the first embodiment of the present invention.
Figure 2:
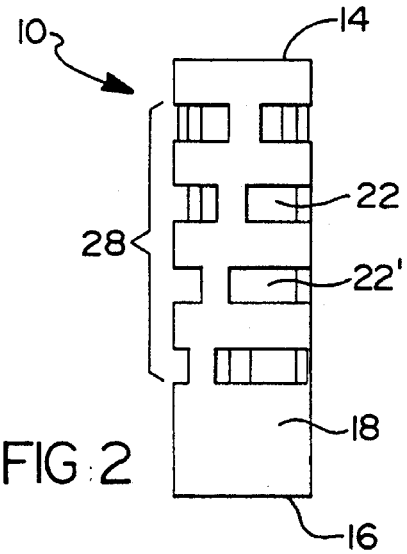
FIG. 2 is a side view of a first embodiment of the present invention.
Figure 4:
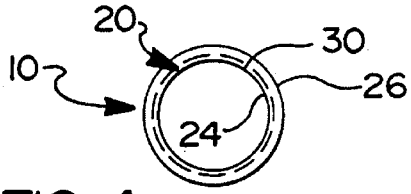
FIG. 4 is a rearward end view of the first embodiment of the present invention.

Referring now to FIGS. 2–4, the first embodiment of the muzzle brake 10 comprises a forward end 14, a rearward end 16, a medial portion 18 and means 20 for attaching the muzzle brake 10 to the rifle 12. The muzzle brake 10 is formed of steel or other suitable metal alloys which can withstand the heat and force associated with the discharge of firearms.

The medial portion 18 has formed therein a plurality of slots 22. Each slot 22 is substantially identical, and comprises a hole formed in the side of the medial portion 18. The hole is of an enlarging circumference as it proceeds from the interior surface 24 to the outer surface 26 of the muzzle brake 10. The slots 22 allow the gases formed during the discharge of the rifle 12 to escape from the interior of the muzzle brake 10, in a manner that will more fully be described herein below.

The slots 22 are arranged into a plurality of rings 28. Each ring 28 comprises three slots 22. As seen in FIG. 2, the number of rings 28 of the first embodiment is four; however, more or less rings may be utilized. The rings 28 are deployed in a manner such that no slot of any one ring is aligned with a slot from any other ring. That is, any one ring has its slots offset to some degree from the slots of any other ring. As seen in FIG. 2, the slot 22 is not aligned with the slot 22', which is disposed slightly clockwise, approximately 10° from the slot 22. Such offsets are similar for all other slots.

This deployment of slots 22 allows for the even distribution of the gases and forces associated with rifle discharge. Each slot 22 allows gas to escape. Since each slot is substantially identical in size, the forces will seek egress from the interior of the muzzle brake 10 from the slots 22, 22' evenly. Further, the orientation of each slot 22, 22' is unique and set such that the forces are balanced as they exit the muzzle brake 10. This prevents the jarring of the rifle 12 during firing, such that the aim and trajectory of the bullet is not altered.

Means 20 for attaching the muzzle brake 10 to the rifle 12 are depicted as threadings 30 deployed around the interior surface 24 proximate the rearward end 14. The threadings 30 would threadingly interconnect with corresponding threadings (not shown) on the barrel of the rifle 12. Alternately, the threadings could be replaced by an interlocking system of slots and stems (not shown) to secure the brake 10 thereon the rifle 12 or other systems as may be known in the art.

Figure 6:
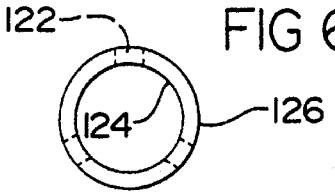
FIG. 6 is a forward end view of the second embodiment of the present invention.
Figure 5:
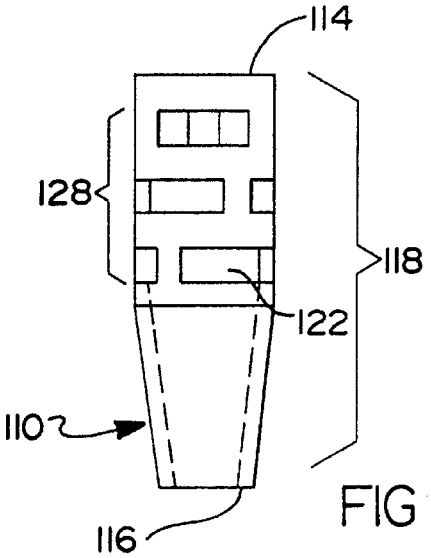
FIG. 5 is a side view of a second embodiment of the present invention.
Figure 7:
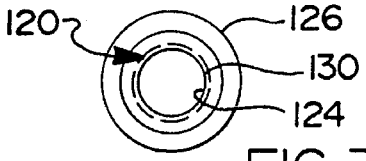
FIG. 7 is a rearward end view of the second embodiment of the present invention.

Referring now to FIGS. 5–7, there is shown a second embodiment of the muzzle brake 110 of the present invention. The medial portion 118 of the brake 110 has formed therein three rings of slots 122. As in the first embodiment, the slots 122 are not aligned such that the forces are dissipated evenly during discharge. Additionally, the medial portion has a taper, such that the diameter of the medial portion 118 is less at the rearward end 116 as compared with the forward portion 114 at the muzzle brake 110. This taper positively affects the directing the expulsion gases during firing toward the slots 122. In all other aspects, the second embodiment of the muzzle brake 110 is identical with the brake 10 of the first embodiment.

Having thus described the invention, what is claimed is:

1. A muzzle break attachment for a rifle, comprising:

(a) cylindrical member having an outer surface and comprising:

(1) a forward end, (2) a rearward end, and (3) a medial portion formed between the forward end and the rearward end;

wherein the cylindrical member has an interior bore of uniform diameter formed therethrough;

and wherein further the medial portion of the cylindrical member has a plurality of slots formed therein having an exterior opening and an interior opening, the slots being formed in a plurality of rings, the slots of each ring being deployed such that no slot in any one ring aligns with any slot from another ring, each slot being defined by a fiat wall the interior opening being of a reduced area relative to the exterior opening.

2. The muzzle brake attachment of claim 1, the member having means for attaching formed proximate the rearward end thereof.

3. The muzzle brake attachment of claim 1, wherein the outer surface of the medial portion is tapered from the rearward end to the front end.

* * * * *